US007753699B2

(12) United States Patent
Wu

(10) Patent No.: US 7,753,699 B2
(45) Date of Patent: Jul. 13, 2010

(54) SAFETY SOCKET

(75) Inventor: Jui-Hsiung Wu, Taipei (TW)

(73) Assignee: Well Shin Technology Co., Ltd., Taipei (TW)

( * ) Notice: Subject to any disclaimer, the term of this patent is extended or adjusted under 35 U.S.C. 154(b) by 0 days.

(21) Appl. No.: 12/326,766

(22) Filed: Dec. 2, 2008

(65) Prior Publication Data

US 2010/0136812 A1 Jun. 3, 2010

(51) Int. Cl.
*H01R 13/648* (2006.01)

(52) U.S. Cl. ..... 439/106; 439/346; 439/144

(58) Field of Classification Search ..... 439/106, 439/110, 346, 144, 147, 137
See application file for complete search history.

(56) References Cited

U.S. PATENT DOCUMENTS 5,069,630 A * 12/1991 Tseng et al. ..... 439/137
6,555,771 B2 * 4/2003 Shao ..... 200/51 R
7,077,683 B1 * 7/2006 Ross ..... 439/346
7,581,977 B1 * 9/2009 Wu ..... 439/346

* cited by examiner

*Primary Examiner*—Truc T Nguyen
(74) *Attorney, Agent, or Firm*—WPAT, P.C.; Anthony King

(57) ABSTRACT

A safety socket adapted for receiving a terminal of a plug includes a socket housing with a plurality of electrodes being mounted thereon, a socket cover coupled with the socket housing and an insulating case mounted between the socket housing and the socket cover. The socket cover has a plurality of insertion holes corresponding to the electrodes. And the insulating case is located above the electrode for holding the terminal separated from the electrode and has a through hole aligned with the electrode and the insertion hole.

12 Claims, 4 Drawing Sheets

SAFETY SOCKET

BACKGROUND OF THE INVENTION

1. Field of the Invention

This present invention relates to a socket, and more specifically to a safety socket capable of preventing electric shock.

2. The Related Art

Electronic products have developed rapidly over the past few decades. With more sockets utilized than before, the safety structure is apparently important for the socket. Generally, an insertion hole of the socket has an electrode made by copper sheet for electrically connecting with a plug. Such socket can be electrically connected with the plug when a terminal of the plug is not fully inserted into the insertion hole of the socket. As a result, when a user contacts the terminal during insertion or extraction of the plug carelessly, it is easy to cause accidents, for example electric shock. So there is a need to design a socket which is able to prevent electric shock.

A safety socket disclosed in the present invention, capable of preventing electric shock, is composed of a socket core housing, a socket core, a socket electrode, a first and second elastic piece. The socket core is rotatably installed in the socket core housing. The socket electrode is mounted in the socket core. The first elastic piece is disposed at an outer surface of the socket core and connected with the socket electrode. The second elastic piece arranged in the socket core housing is spaced away from the first elastic piece with a predetermined angle. When in use, a plug is inserted into the socket core to connect with the socket electrode, and then the plug is rotated with the socket core through the predetermined angle and finally the first elastic piece is connected with the second elastic piece. Thus the plug is electrically connected with the safety socket. However, such structure is so complicated that the safety socket is difficult to be manufactured and assembled, furthermore, inconvenient for the user to operate.

SUMMARY OF THE INVENTION

An object of the invention is to provide a safety socket having a structure which is easy to manufacture and assemble, and convenient to operate. The safety socket adapted for receiving a terminal of a plug includes a socket housing with a plurality of electrodes being mounted thereon, a socket cover coupled with the socket housing and an insulating case mounted between the socket housing and the socket cover. The socket cover has a plurality of insertion holes corresponding to the electrodes. And the insulating case is located above the electrode for holding the terminal separated from the electrode and has a through hole aligned with the electrode and the insertion hole.

As described above, the safety socket has the insulating case above the electrode. When the plug is not fully inserted into or extracted out of the safety socket, the terminal received in the insulating case is separated from the electrode, which avoids the terminal to be electrified, consequently, preventing the user from electric shock. Furthermore, because such construction of the safety socket is simple and the plug need not be rotated to engage with the safety socket in use, the safety socket is not only easy to be manufactured and assembled, but also convenient for the user to operate.

BRIEF DESCRIPTION OF THE DRAWINGS

The invention, together with its objects and the advantages thereof may be best understood by reference to the following description taken in conjunction with the accompanying drawings, in which.

DETAILED DESCRIPTION OF THE EMBODIMENT

Figure 1:
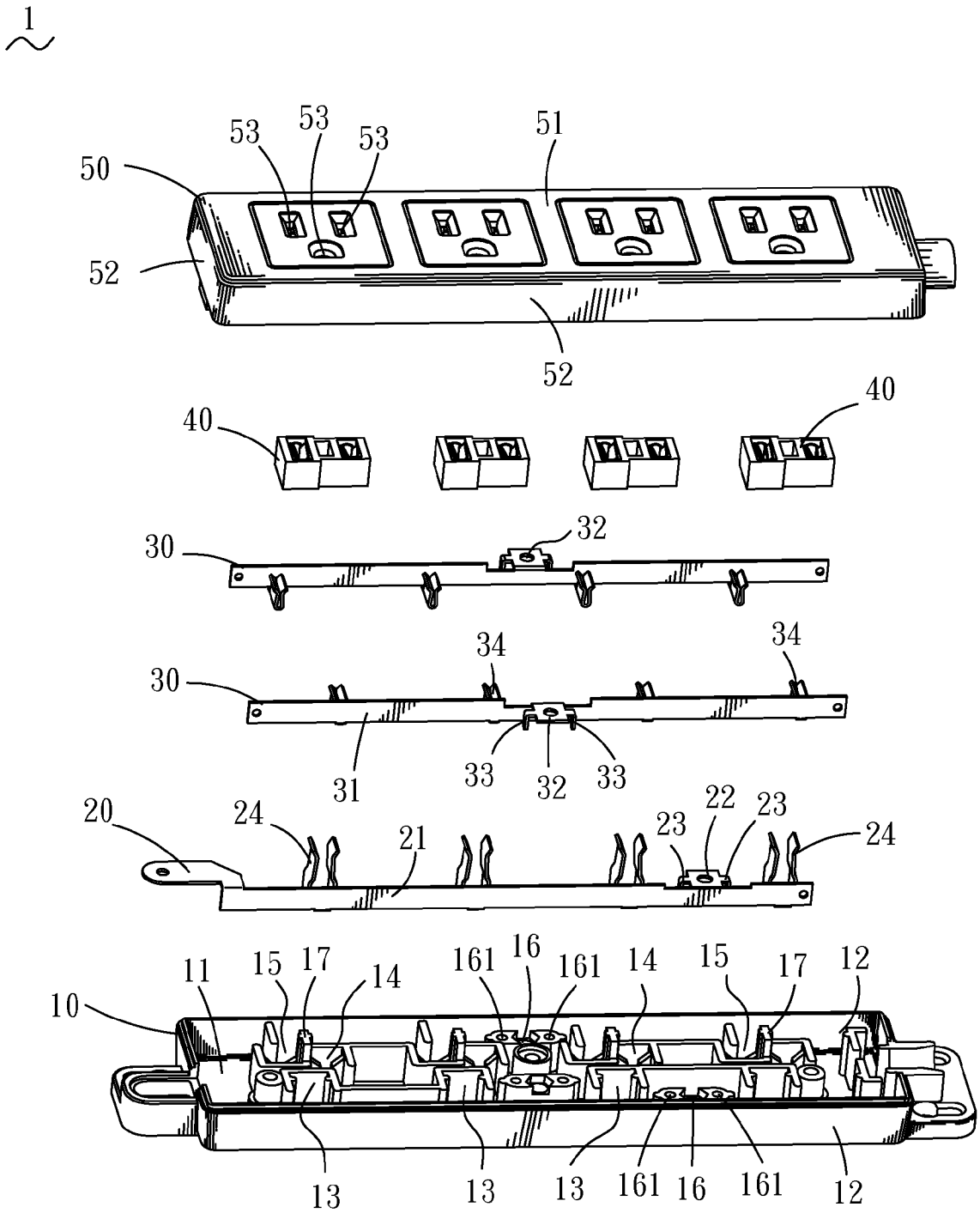
FIG. 1 is an exploded, perspective view of a safety socket of an embodiment in accordance with the present invention.

Referring to FIG. 1, an embodiment of a safety socket 1 according to the present invention is shown. The safety socket 1 includes a socket housing 10, a first connection element 20, two second connection elements 30, a plurality of insulating cases 40 and a socket cover 50 coupled with the socket housing 10.

The socket housing 10 has a basic plate 11 and a sidewall 12 enclosing the basic plate 11 to form a receiving chamber. A plurality of first, second and third receiving portions 13, 14, 15 are formed in the receiving chamber. The first receiving portions 13 are arranged at intervals in a first row and respectively define an opening facing a front of the socket housing 10. The second receiving portions 14 are arranged at intervals in a second row spaced from the first row with a narrow gap and respectively define an opening facing the front of the socket housing 10. The third receiving portions 15 are arranged at intervals in the second row as the second receiving portions 14 and respectively define an opening facing a rear of the socket housing 10. Each of the third receiving portions 15 is adjacent to the corresponding second receiving portion 14. The basic plate 11 further has a plurality of holding portions 16 and positioning portions 17. Each of the holding portions 16 adapted for respectively fixing the first connection element 20 and the second connection elements 30, has two holding holes 161 arranged abreast on a top thereof. The positioning portion 17, flat-board shape, is disposed between the second receiving portion 14 and the third receiving portion 15, and higher than the sidewall 12 for fixing the insulating case 40.

The first connection element 20 mounted in the first row has a first conductive portion 21. The first conductive portion 21 is an elongated plate shape. A portion of a top edge of the first conductive portion 21 extends substantially perpendicular to the first conductive portion 21 to form a first fixing portion 22 for covering the top of the corresponding holding portion 16. Middles of two sides of the first fixing portion 22 are bent downwardly to form buckling portions 23. The buckling portion 23 is inserted into the corresponding holding hole 161 for fixing the first connection element 20 to the socket housing 10. A bottom edge of the first conductive portion 21 has plural portions extending upwards to form a plurality of first electrodes 24. The first electrodes 24 are U-shaped and received in the corresponding first receiving portions 13 of the first row.

The second connection elements 30 are respectively mounted in the second row. The construction of the second connection element 30 is somewhat analogous to that of the first connection element 20. The second fixing portion 32 is adapted for mating with the corresponding holding portion 16, and the buckling portion 33 is inserted into the corresponding holding hole 161 for securing the second connection element 30 to the socket housing 10. The second electrodes 34 are received in the corresponding second and third receiving portions 14, 15. Thereinto, the second electrodes 34 are smaller than the first electrodes 24.

Figure 2:
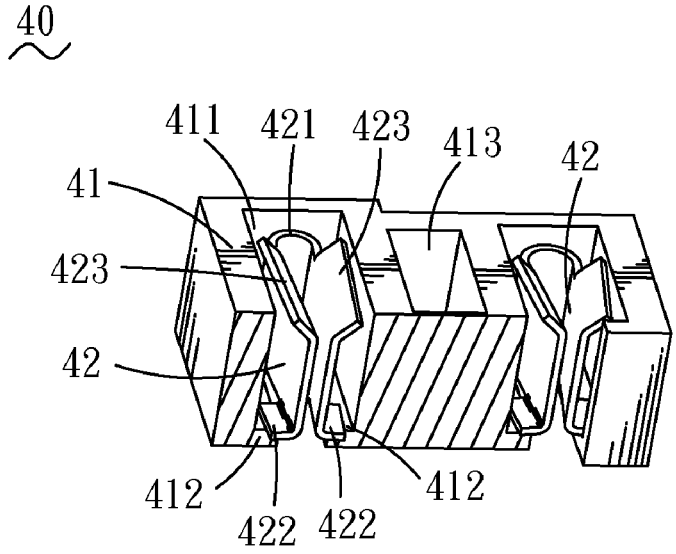
FIG. 2 is a partly cross-sectional view of an insulating case of the safety socket shown in FIG. 1.

Please refer to FIG. 1 and FIG. 2, the insulating case 40 includes an insulating body 41 and an elastic component 42 mounted in the insulating body 41. The insulating body 41 has two through holes 411. The through holes 411 extend upwards and downwards, and are arranged at certain intervals. Two bottom sides of the through hole 411 extend facing each other with a predetermined distance to form a supporting portion 412, respectively. A positioning hole 413 is arranged between the two through holes 411 and passes through the whole insulating case 40 for receiving the positioning portion 17. The elastic component 42 received in the through hole 411 may be made of insulating material or metal material. The elastic component 42 has a bending portion 421. The bending portion 421 which is substantially U-shaped with an opening thereof narrowed is placed in the through hole 411 horizontally for elastically clamping a terminal of plug (shown in FIG. 4). Two portions of a top side of the bending portion 421 are curved outwards to form a leading portion 423, respectively, for conveniently inserting the terminal into the bending portion 421. A bottom side of the bending portion 421 also has two portions perpendicularly extending outwards to form a resistive portion 422, respectively. The resistive portion 422 is carried by the corresponding supporting portion 412 for holding the elastic component 42.

Figure 3:
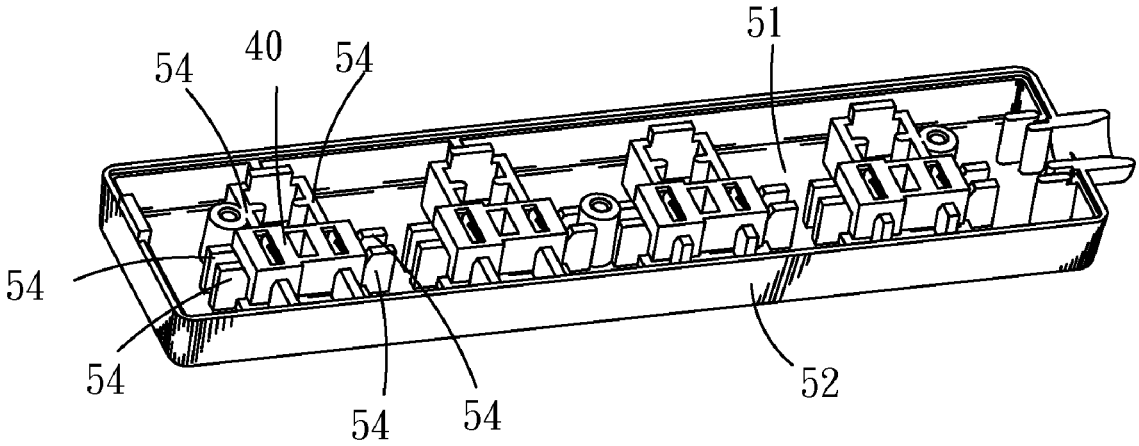
FIG. 3 is a perspective view of a socket cover of the safety socket shown in FIG. 1 seen from a bottom view, wherein the insulating case is mounted thereon.

Please refer to FIG. 1 and FIG. 3, the socket cover 50 defines a covering plate 51 and a lateral plate 52 bending perpendicularly from an edge of the covering plate 51 to form a chamber. The covering plate 51 has a plurality of insertion holes 53. The insertion holes 53 are located corresponding to the first electrodes 24 and second electrodes 34 for allowing the terminals to pass therethrough. The covering plate 51 extends towards the chamber to form a plurality of protrusions 54 to form a space around each of the insertion holes 53 for accommodating the insulating case 40.

Figure 4:
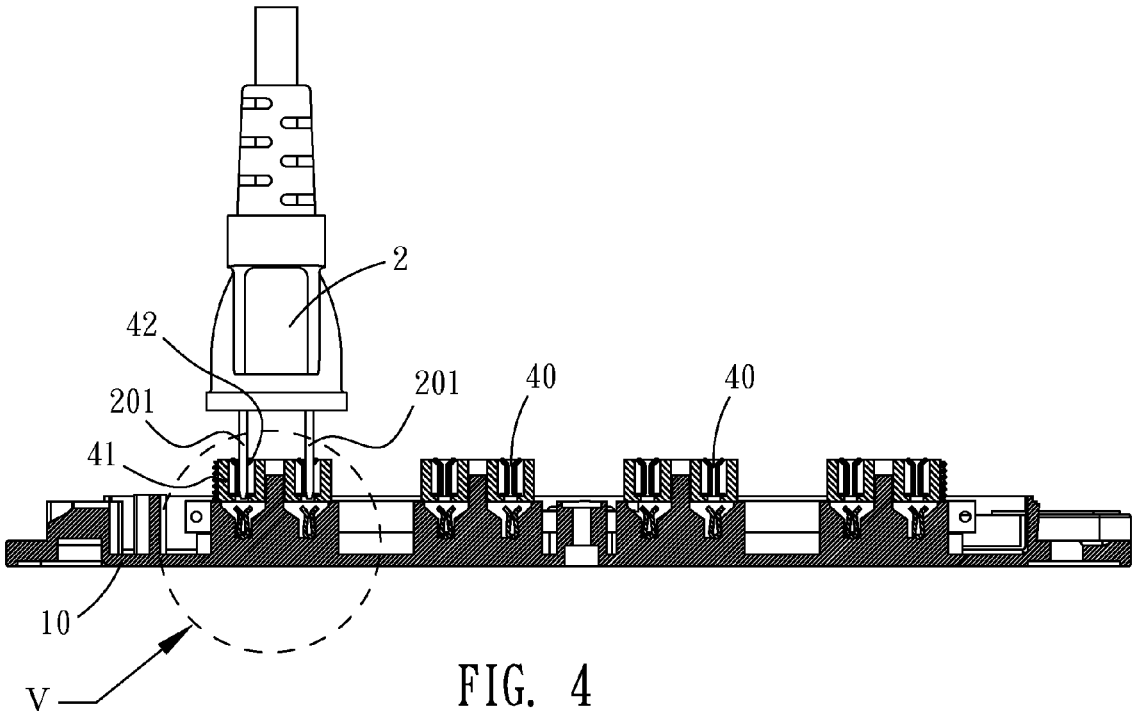
FIG. 4 is a schematic view illustrating a usage state of a plug incompletely inserted into the safety socket of FIG. 1, wherein the socket cover is removed.
Figure 5:
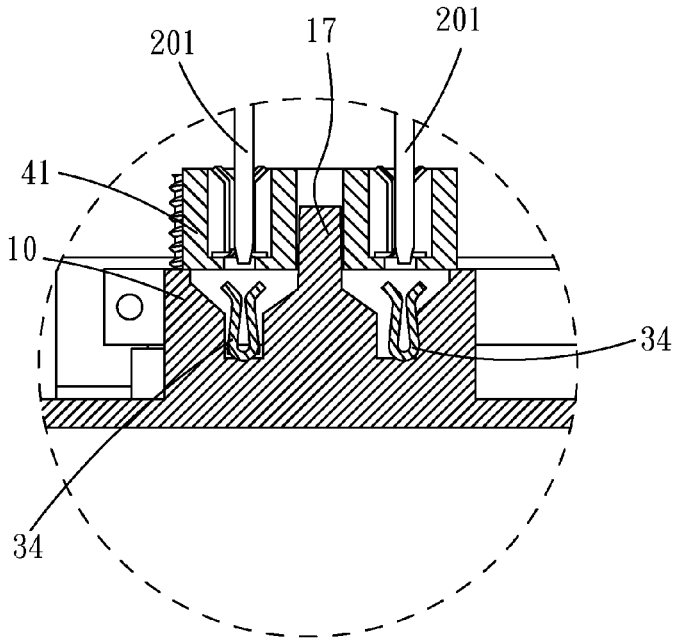
FIG. 5 is a partly enlarged view showing an enlarged V portion of FIG. 4.

With reference to FIG. 1 and FIGS. 4-5, the first connection element 20 and the second connection elements 30 are mounted in the socket housing 10, and the first and second electrodes 24 and 34 are respectively accommodated in the corresponding receiving portions 13, 14 and 15. The socket cover 50 is engaged with the socket housing 10, and the insulating case 40 is firmly disposed between the socket housing 10 and the socket cover 50 because the positioning hole 413 mates with the positioning portion 17 and the insulating case 40 is enclosed by the protrusions 54. Thus the insertion hole 53, the through hole 411 and the second electrode 34 are aligned with each other.

Figure 6:
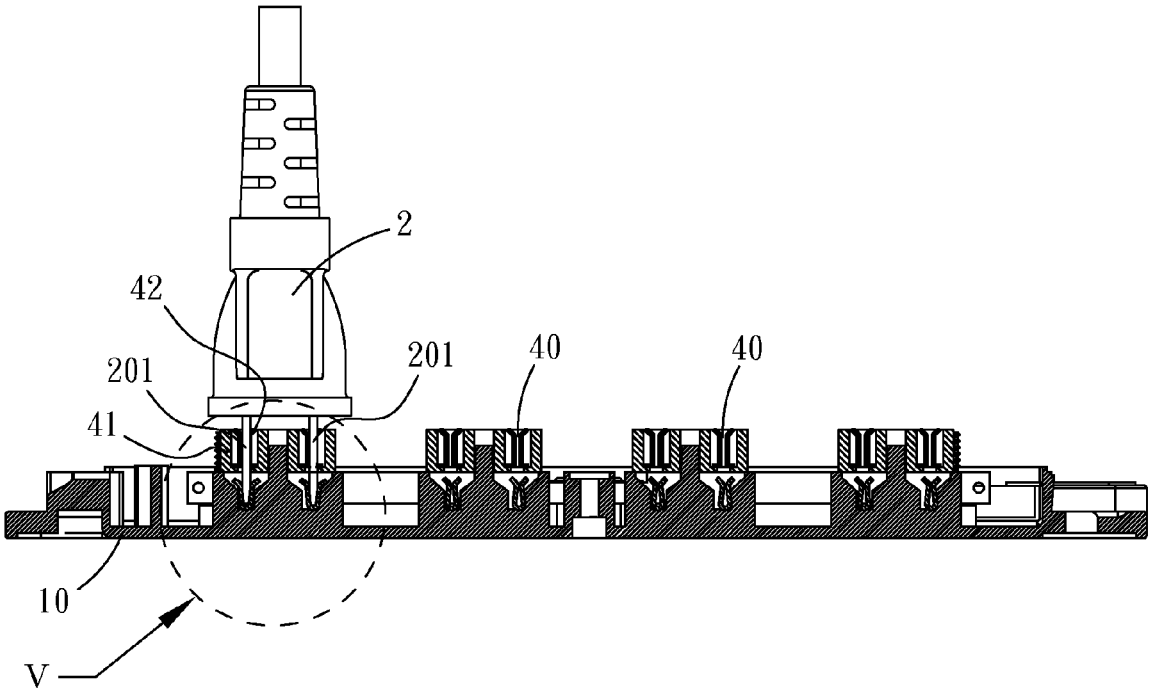
FIG. 6 is a schematic view illustrating a usage state of the plug fully inserted into the safety socket of FIG. 1, wherein the socket cover is removed.
Figure 7:
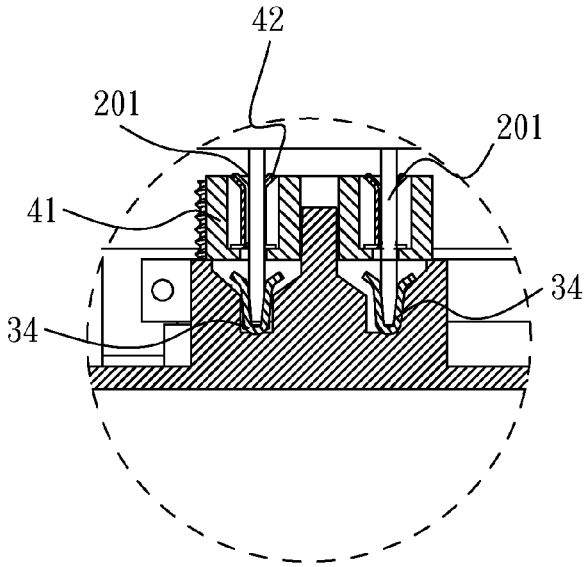
FIG. 7 is a partly enlarged view showing an enlarged VII portion of FIG. 6.

When a plug 2 is inserted into the safety socket 1, a terminal 201 of the plug 2 is firstly inserted into the bending portion 421 under the guidance of the leading portion 423. At this time, the terminal 201 is not connected electrically with the second electrodes 34. Namely, the terminal 201 is not electrified, accordingly, preventing from electric shock. So the users will be safe in this operation even though touch the terminal 201 unintentionally. Please refer to FIG. 6 and FIG. 7, the plug 2 is required to be continually pressed inwards and finally, the terminal 201 is electrically connected with the second electrodes 34. At this time, because the terminal 201 of the plug 2 exposed outside is short, it is not easy to happen accidents. Therefore the safety socket 1 is capable of preventing from electric shock effectively.

As described above, the safety socket 1 has the insulating case 40 above the second electrode 34. When the plug 2 is not fully inserted into or extracted out of the safety socket 1, the terminal 201 received in the insulating case 40 is separated from the second electrode 34, which avoids the terminal 201 to be electrified, consequently, preventing the user from electric shock. Furthermore, because such construction of the safety socket 1 is simple and needless to require the plug 2 to be rotated to engage with the safety socket 1 in use, the safety socket 1 is not only easy to be manufactured and assembled, but also convenient for the user to operate.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A safety socket adapted for receiving a terminal of a plug, comprising:

a socket housing, a plurality of electrodes being mounted on the socket housing;

a socket cover coupled with the socket housing, the socket cover having a plurality of insertion holes corresponding to the electrodes; and an insulating case mounted between the socket housing and the socket cover and located above the electrode for holding the terminal separated from the electrode, the insulating case having a through hole aligned with the electrode and the insertion hole;

wherein the insulating case has an elastic component mounted in the through hole, the elastic component defines a bending portion, the bending portion which is substantially U-shaped with an opening thereof narrowed is disposed in the through hole for elastically clamping the terminal of the plug.

2. The safety socket as claimed in claim 1, wherein a bottom of the through hole extends inwards with a certain distance to form a supporting portion for supporting a resistive portion curving outwards from a bottom edge of the bending portion for holding the elastic component.

3. The safety socket as claimed in claim 1, wherein a top edge of the bending portion has a portion curving outwards to form a leading portion for conveniently inserting the terminal of the plug into the bending portion.

4. A safety socket adapted for receiving a terminal of a plug, comprising:

a socket housing, a plurality of electrodes being mounted on the socket housing;

a socket cover coupled with the socket housing, the socket cover having a plurality of insertion holes corresponding to the electrodes; and an insulating case mounted between the socket housing and the socket cover and located above the electrode for holding the terminal separated from the electrode, the insulating case having a through hole aligned with the electrode and the insertion hole;

wherein a surface of the socket cover facing the socket housing has a plurality of protrusions arranged around the insertion hole to form a space for accommodating the insulating case.

5. The safety socket as claimed in claim 4, wherein the insulating case defines an insulating body, the through holes are opened in the insulating body corresponding to the electrodes; a positioning hole is disposed between the through holes for mating with a positioning portion formed on the socket housing for positioning the insulating case to the socket housing.

6. The safety socket as claimed in claim 4, wherein the insulating case has an elastic component mounted in the through hole, the elastic component defines a bending portion, the bending portion which is substantially U-shaped with an opening thereof narrowed is disposed in the through hole for elastically clamping the terminal of the plug.

7. The safety socket as claimed in claim 6, wherein a bottom of the through hole extends inwards with a certain distance to form a supporting portion for supporting a resistive portion curving outwards from a bottom edge of the bending portion for holding the elastic component.

8. The safety socket as claimed in claim 6, wherein a top edge of the bending portion has a portion curving outwards to form a leading portion for conveniently inserting the terminal of the plug into the bending portion.

9. A safety socket adapted for receiving a terminal of a plug, comprising:

a socket housing, a plurality of electrodes being mounted on the socket housing;

a socket cover coupled with the socket housing, the socket cover having a plurality of insertion holes corresponding to the electrodes; and an insulating case mounted between the socket housing and the socket cover and located above the electrode for holding the terminal separated from the electrode, the insulating case having a through hole aligned with the electrode and the insertion hole;

wherein the insulating case defines an insulating body, the through holes are opened in the insulating body corresponding to the electrodes; a positioning hole is disposed between the through holes for mating with a positioning portion formed on the socket housing for positioning the insulating case to the socket housing.

10. The safety socket as claimed in claim 9, wherein the insulating case has an elastic component mounted in the through hole, the elastic component defines a bending portion, the bending portion which is substantially U-shaped with an opening thereof narrowed is disposed in the through hole for elastically clamping the terminal of the plug.

11. The safety socket as claimed in claim 10, wherein a bottom of the through hole extends inwards with a certain distance to form a supporting portion for supporting a resistive portion curving outwards from a bottom edge of the bending portion for holding the elastic component.

12. The safety socket as claimed in claim 10, wherein a top edge of the bending portion has a portion curving outwards to form a leading portion for conveniently inserting the terminal of the plug into the bending portion.

* * * * *